US010477913B2

(12) United States Patent
Gilkey

(10) Patent No.: US 10,477,913 B2
(45) Date of Patent: Nov. 19, 2019

(54) OUTWARD ROTATING GOLF SHOES

(71) Applicant: Scott Lawrence Gilkey, Alpharetta, GA (US)

(72) Inventor: Scott Lawrence Gilkey, Alpharetta, GA (US)

( * ) Notice: Subject to any disclaimer, the term of this patent is extended or adjusted under 35 U.S.C. 154(b) by 222 days.

(21) Appl. No.: 15/637,112

(22) Filed: Jun. 29, 2017

(65) Prior Publication Data

US 2017/0354198 A1 Dec. 14, 2017

Related U.S. Application Data

(63) Continuation-in-part of application No. 14/672,592, filed on Mar. 30, 2015, now abandoned.

(51) Int. Cl.

| | |
|---|---|
| ***A43B 5/00*** | (2006.01) |
| ***A43B 13/22*** | (2006.01) |
| ***A43B 3/00*** | (2006.01) |

(52) U.S. Cl.

CPC ..... *A43B 5/001* (2013.01); *A43B 3/0042* (2013.01); *A43B 3/0068* (2013.01); *A43B 5/005* (2013.01); *A43B 13/223* (2013.01)

(58) Field of Classification Search

CPC ..... A43B 3/0042; A43B 5/001; A43B 13/22; A43B 13/223; A43B 13/26; A43C 15/02

See application file for complete search history.

(56) References Cited

U.S. PATENT DOCUMENTS

| | | | | | |
|---|---|---|---|---|---|
| 1,876,195 | A * | 9/1932 | Youmans | A43C 13/04 | 36/127 |
| 2,307,727 | A * | 1/1943 | Hubbard | A43B 3/0026 | 36/59 R |
| 3,006,085 | A * | 10/1961 | Bingham, Jr. | A43B 13/223 | 36/59 C |
| 3,354,561 | A * | 11/1967 | Cameron | A43B 3/0042 | 36/128 |
| 3,707,047 | A * | 12/1972 | Nedwick | A43B 3/0042 | 36/114 |
| 4,564,966 | A * | 1/1986 | Chen | A43B 1/0027 | 12/146 B |
| 4,577,422 | A * | 3/1986 | Tanel | A43C 13/04 | 36/126 |
| 4,653,206 | A * | 3/1987 | Tanel | A43C 13/04 | 36/126 |
| 4,660,304 | A * | 4/1987 | Tanel | A43C 13/04 | 36/126 |
| 4,670,997 | A * | 6/1987 | Beekman | A43B 13/223 | 36/114 |
| 4,689,901 | A * | 9/1987 | Ihlenburg | A43B 3/0042 | 36/114 |
| 5,313,718 | A * | 5/1994 | McMahon | A43B 13/26 | 36/114 |

(Continued)

*Primary Examiner* — Katharine Gracz

(57) ABSTRACT

A golf shoe sole with a pattern configured for outward, one-way rotation includes a pattern with a rotation point pattern. The rotation point pattern includes a center point treat or center cone spike, whereby the golf shoe is configured to rotate about the center point tread of the rotational pattern. The pattern can also include more than one one-way rotation patterns. Each of the one-way rotation patterns include a plurality of one-way guide blades and more than one row of parallel outward one-way rotation guide blades. The pattern can also include one or more circle blades encircling the center cone spike.

16 Claims, 19 Drawing Sheets

(56) References Cited

U.S. PATENT DOCUMENTS

| | | | | | |
|---|---|---|---|---|---|
| 5,566,478 | A * | 10/1996 | Forrester | A43B 3/0042 | 36/126 |
| 5,943,794 | A * | 8/1999 | Gelsomini | A43B 3/0094 | 36/127 |
| 6,035,559 | A * | 3/2000 | Freed | A43B 3/0042 | 36/115 |
| 6,354,022 | B2 * | 3/2002 | Gelsomini | A43B 3/0094 | 36/127 |
| 7,549,239 | B2 * | 6/2009 | Drollinger | A43B 3/0042 | 36/127 |
| 7,654,014 | B1 * | 2/2010 | Moore | A43B 3/0042 | 36/127 |
| 7,762,009 | B2 * | 7/2010 | Gerber | A43B 13/26 | 36/128 |
| 2002/0088147 | A1 * | 7/2002 | Joo | A43B 3/0042 | 36/127 |
| 2006/0032092 | A1 * | 2/2006 | Drollinger | A43B 3/0042 | 36/134 |
| 2007/0199211 | A1 * | 8/2007 | Campbell | A43B 5/001 | 36/59 R |
| 2007/0199213 | A1 * | 8/2007 | Campbell | A43B 3/0057 | 36/102 |
| 2010/0186260 | A1 * | 7/2010 | Colthurst | A43B 3/0042 | 36/103 |
| 2012/0005921 | A1 * | 1/2012 | Diepenbrock | A43B 7/144 | 36/28 |
| 2012/0159816 | A1 * | 6/2012 | Wu | A43B 13/26 | 36/134 |
| 2014/0096417 | A1 * | 4/2014 | Futrell | A43B 13/14 | 36/25 R |
| 2015/0359294 | A1 * | 12/2015 | VanHook | A43B 13/16 | 36/25 R |

* cited by examiner

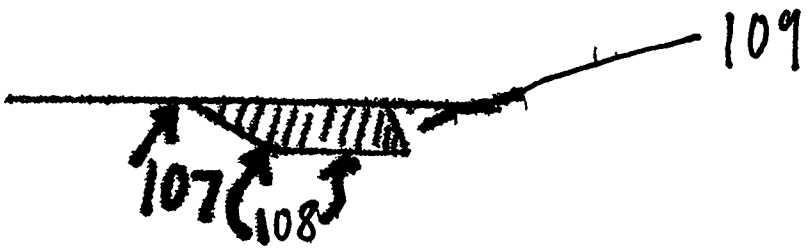
Fig 3A1

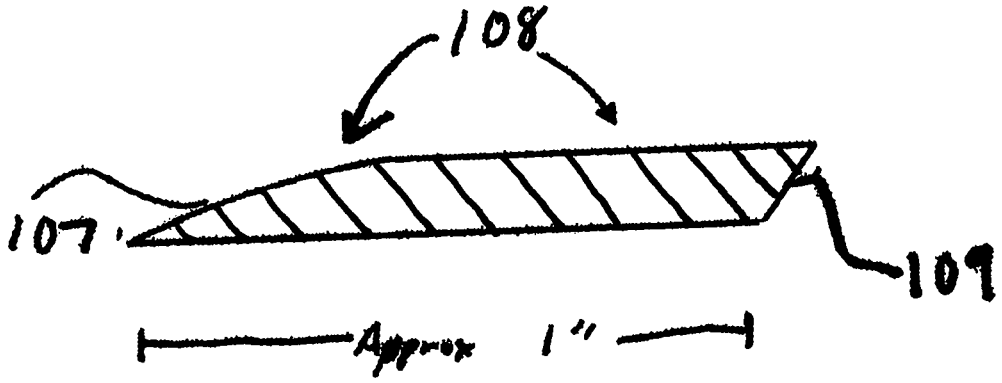
Fig 3A²

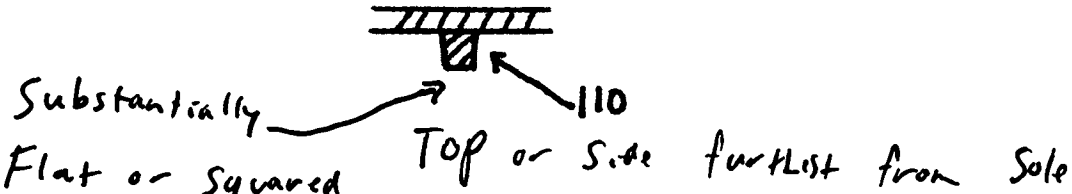
Fig 3B1

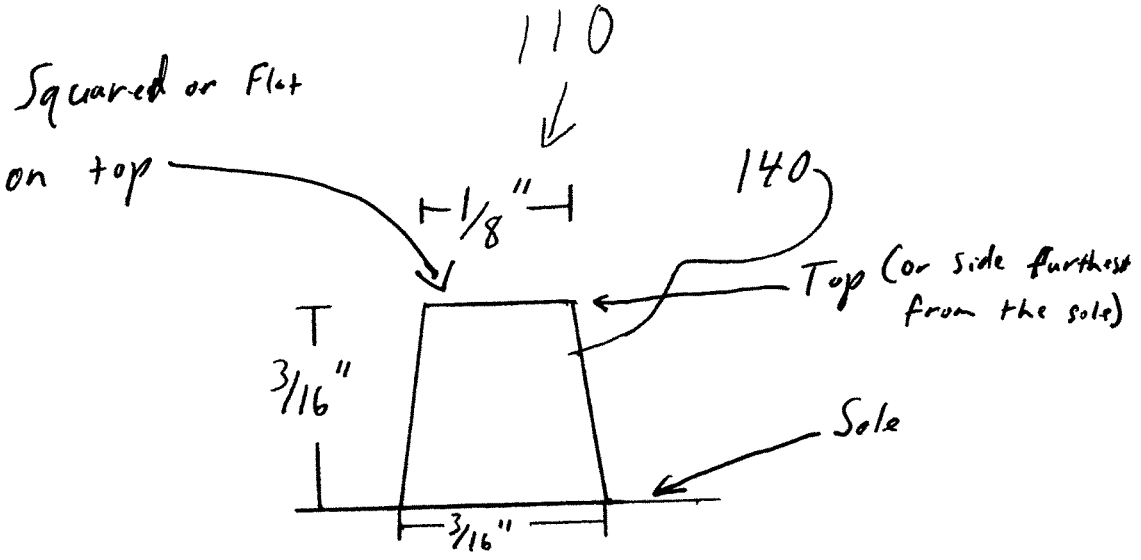
Fig 3B²

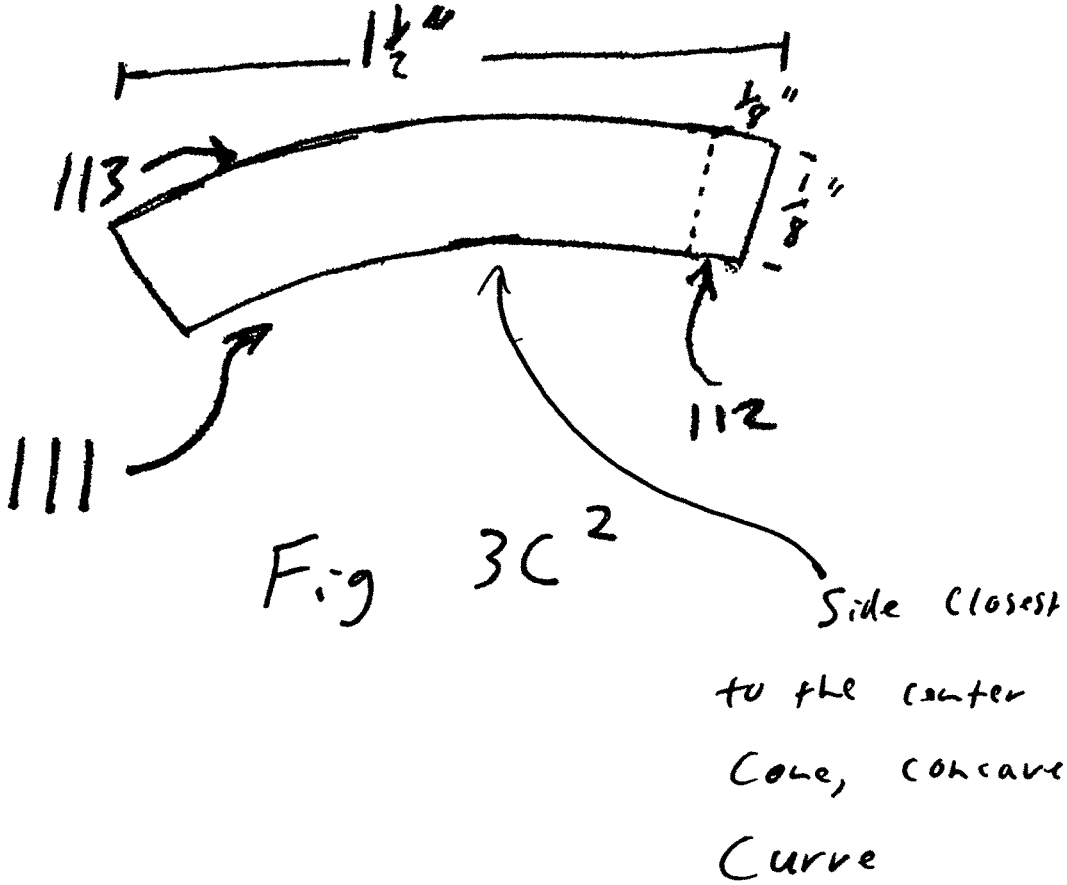
Fig 3C²

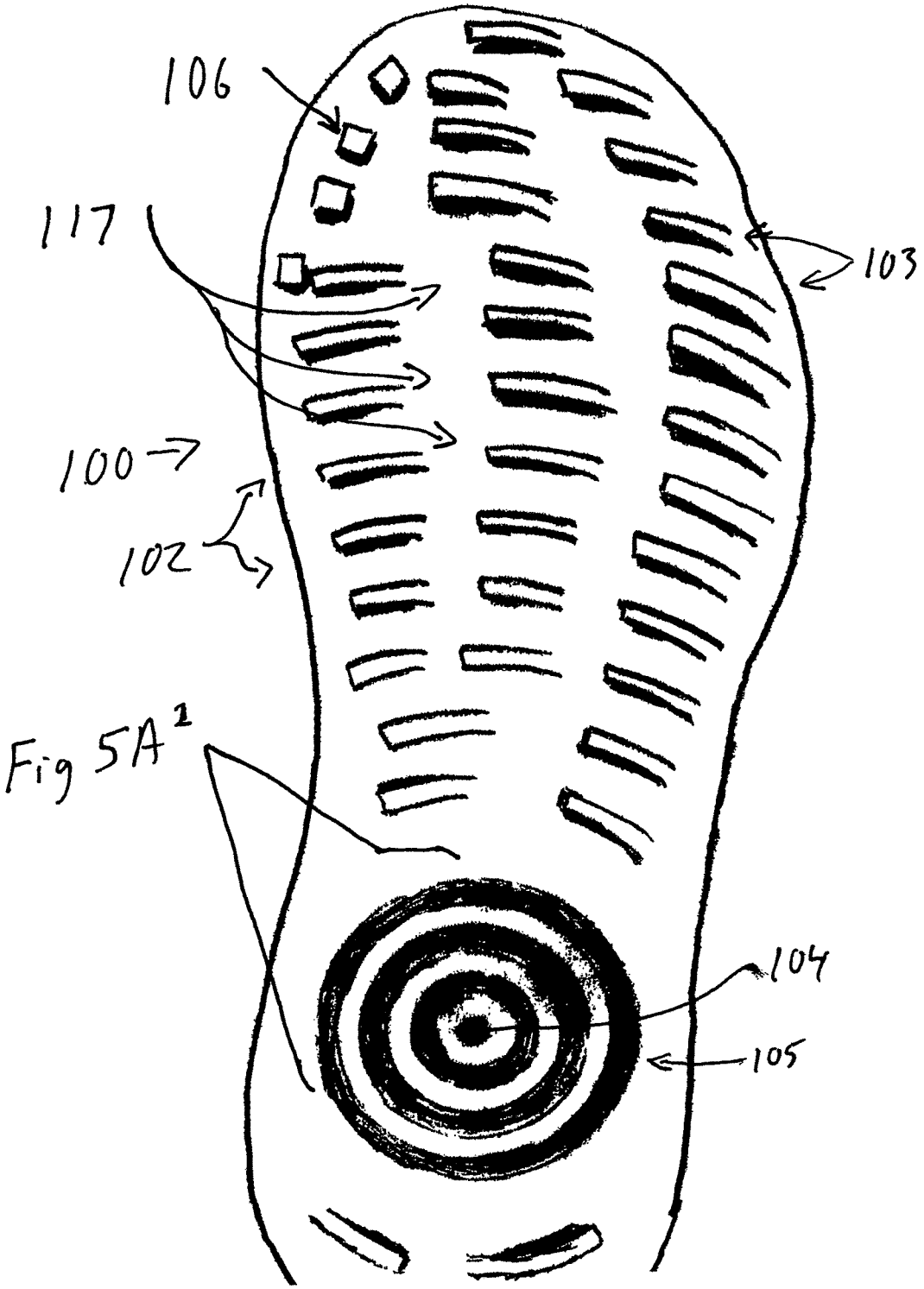
106
117
103
100
102
Fig 5A²
104
105

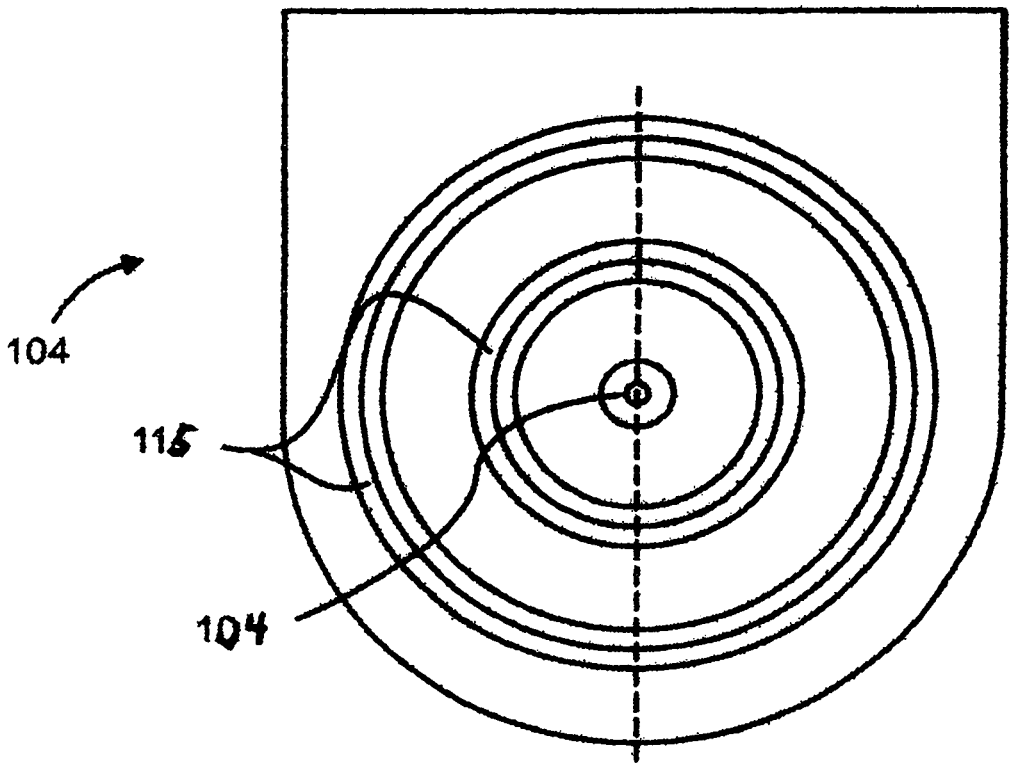
Fig 5A²

106
115

OUTWARD ROTATING GOLF SHOES

BACKGROUND OF THE DISCLOSURE

Technical Field of the Disclosure

The disclosure generally relates to shoes and soles for shoes. More specifically, the disclosure relates to a golf shoe sole with an outward rotating one-way rotation tread pattern.

Description of the Related Art

A proper golf swing requires the golfer to rotate his/her hips toward the target area or the toward where the golfer is trying to hit the ball. It should be readily understood that the smoother and more fluent the frontward rotation is during and upon follow through of the golf swing, the better the swing, i.e. more consistency, more power, reduction in injuries, etc. It should also be understood that the follow through causes the most stress on the golfer's lower back, knee, and ankle than any other point in golf swing because the golfer's front foot is still positioned perpendicular to the line of the shot while the hips and shoulders have rotated to also be perpendicular to the line of the shot thus the hips and shoulders are parallel to the golfer's front foot, a most unnatural position. The instant disclosure recognizes that it is desired to allow the front foot or the foot closest to the target area to rotate outwardly thus finishing in the natural position of perpendicular to the golfer's hips and shoulders. The instant disclosure contemplates that many golfers could play more often with less pain or soreness and at a higher level if the follow through of his/her swing was smoother and ended in a more natural position. It also contemplates that a lot of the wear and tear cause by the golf swing to avid golfer could be eliminated thus allowing a lot more longevity for the avid golfer. Most avid golfers and almost all professional golfers have back surgery at some point in their life. The instant disclosure contemplates that most of these surgeries would be prevented with the use of this outward rotating golf shoe.

Therefore, it is readily apparent that there is a recognizable unmet need for a golf shoe sole that provides an outward one-way tread pattern.

SUMMARY

Briefly described, in a possibly preferred embodiment, the present apparatus overcomes the above-mentioned disadvantages and meets the recognized need for such a device by providing a golf shoe sole with a pattern configured for an outward one-way rotation. The golf shoe sole with the outward one-way rotation pattern may be designed to allow the front foot to smoothly rotate with the golfer's body after contact with the ball during the follow through.

The present apparatus and method includes a pattern having a rotation point pattern. The rotation point pattern may include a center point tread, whereby the golf shoe sole may be configured to rotate about the center point tread of the rotational point pattern.

One feature may be that the center point tread may by substantially conical shaped with the widest part of the cone being attached to the sole and the pointed part of the cone being the part furthest from the sole. The center point tread may be recognized as a center cone spike.

Another feature may be that there is only one center point tread or center cone spike at which the shoe rotates about. The only center cone spike may be located substantially in the heal portion of the sole.

Another feature may be that the rotation point pattern may include at least one ring tread around the center point tread. In select embodiment, the rotation point pattern may include two or more ring treads around the center point tread. In select embodiments, the ring treads may have a substantially squared shaped top or area furthest from the sole.

Another feature may be that the center point tread may have a center height that may be approximately equal to the height of the ring treads.

In select embodiments, the pattern configured for one way rotation may include more than one one-way rotation patterns. The one-way rotation pattern may include at plurality of one-way guild blades. In select embodiments, the one-way guild blades may have a radius of curvature approximately equal to the distance from the center of the rotation point pattern or center cone spike.

One feature of the one-way guide blades may be the inclusion of a slide end configured to allow rotation and a stop end to restrict rotation and provide traction. In select embodiments, the slide end may gradually protrude from the sole to a slightly rounded portion before becoming parallel with the sole and the stop end may include a sharp cut back, acute angle at the top (furthest part from the sole) of the blade attaching to the sole at an inverse angle that produces a barb that extends past where the blade meets the sole on this side. In select embodiments, each of the one-way guide blades may include a substantially squared shaped top portion.

One feature may be that the one-way rotation patterns may included a plurality of rows of the one-way guide blades, where each of the rows of the one-way guide blades are substantially arced parallel to each other so that each row is in a radial arc about the center cone spike. It other word, each row is in an orbital pattern about the center cone spike so if you measure any point on a particular row it will measure the same distance from the center cone spike as any other point on the same said row.

One feature of the one-way rotation tread pattern may be the inclusion in at the one-way rotation patterns of a counter rotate spike. In select various embodiments, the counter rotate spike may be positioned at the inner toe portion of the sole, may have a substantially square or trapezoidal cross-section. The counter rotate spike may be configured to give traction extension during the counter rotate portion or start of the swing and provide traction walking.

One other feature is that only the front shoe, left shoe for a right handed golfer and right shoe for the left handed golfer, may have this pattern. The other or rear shoe may have substantially traditional tread design to provide tractions in all directions.

BRIEF DESCRIPTION OF THE DRAWINGS

The present golf shoe sole with an outward, one-way rotation tread patter will be better understood by reading the Detailed Description with reference to the accompanying drawings, which are not necessarily drawn to scale, and in which like reference numerals denote similar structure and refer to like elements throughout, and in which:

FIG. 3$B_{(1,2)}$ is a side head on view of the one-way guild blade from FIG. 5A showing the flat or squared top or side furthest from the sole;

FIG. 3$C_{(1,2)}$ is the top view of an exemplary embodiment of one of the one-way guide blades displaying the concave curve towards the center cone;

FIG. 5$A_{(1,2)}$ is a top view of an exemplary embodiment of the rotation point pattern with the center point tread or center cone spike;

DETAILED DESCRIPTION

In describing the exemplary embodiment of the present disclosure, as illustrated in FIGS. 1-10, specific terminology is employed for the sake of clarity. The present disclosure, however, is not intended to be limited to the specific terminology so selected, and it is to be understood that each specific element included all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-10 by way of examples, and not limitations, therein is illustrated example embodiments of sole 100 with pattern 102 a center point tread or center cone spike encircled by rotational point pattern of circle blades and one-way rotational blades on the further circumferences of the sole.

Sole 100 with pattern 102 may be made up of any material for providing one way rotation to sole 100.

The characteristics of the sole will be displayed and described with element 103 and up.

103 in the FIGS. 1-10 represents the actual outward, one-way blade located on the front portion and very rear portion of the sole.

104 represents the center point tread or center cone spike.

105 represents the circle blades forming the rotational point pattern.

106 represents the counter rotation spike.

Figure 1:
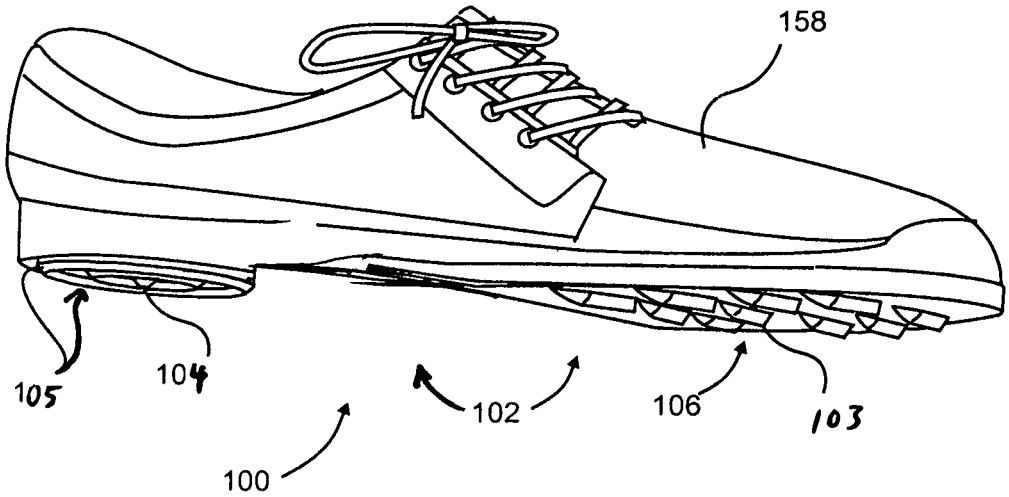
FIG. 1 is a side perspective view of an exemplary embodiment of the golf shoe sole with the outward, one-way rotation tread pattern on a golf shoe with the rotation point pattern in the heel portion and the outward, one-way rotation pattern in the front portion.
Figure 2A:
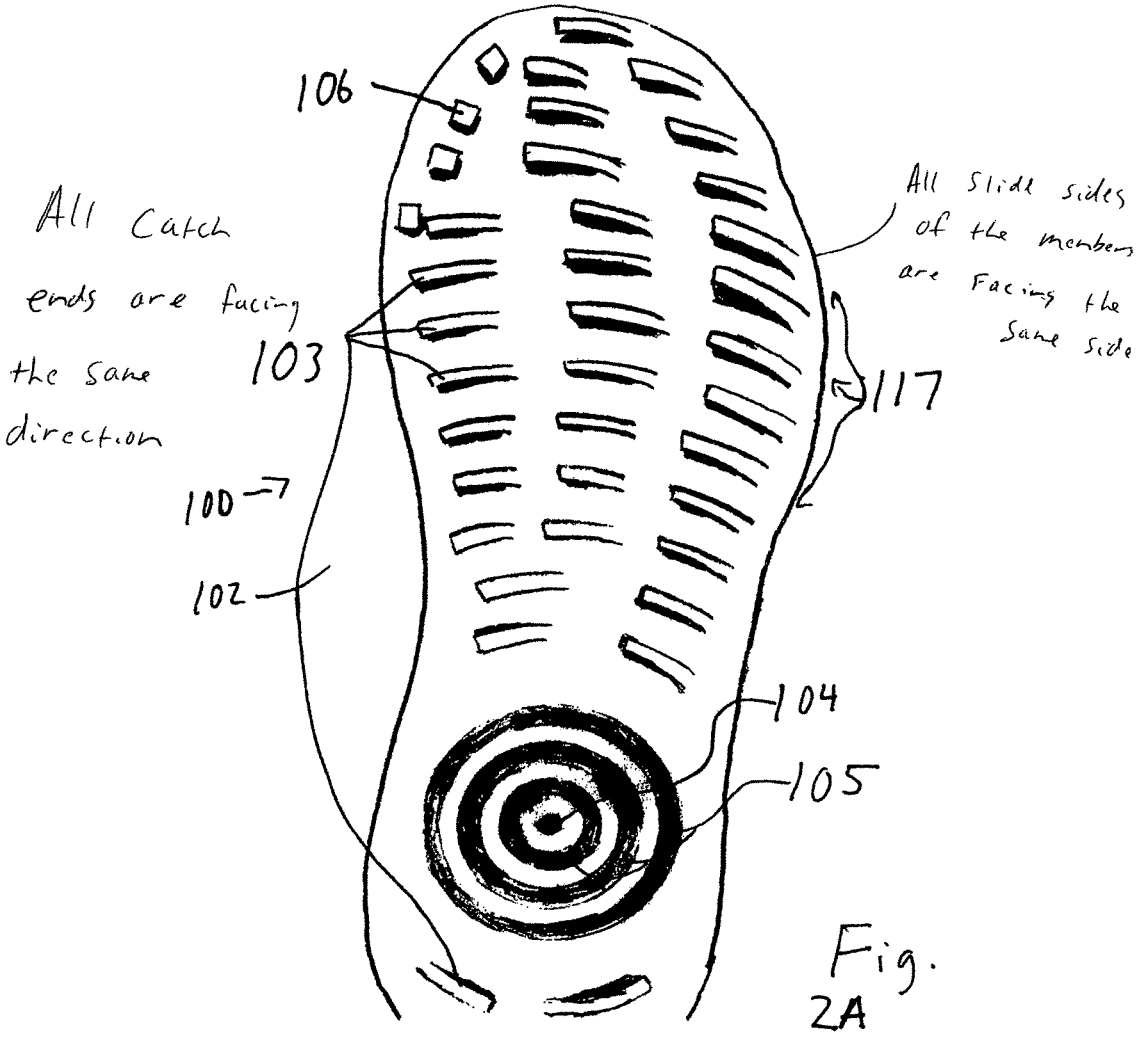
FIG. 2A is a bottom perspective view of the embodiment from FIG. 1A illustrating that the sloped or inclined plane end of each member is facing the same direction and on the same side closed to the outside edge of the sole.
Figure 2B:
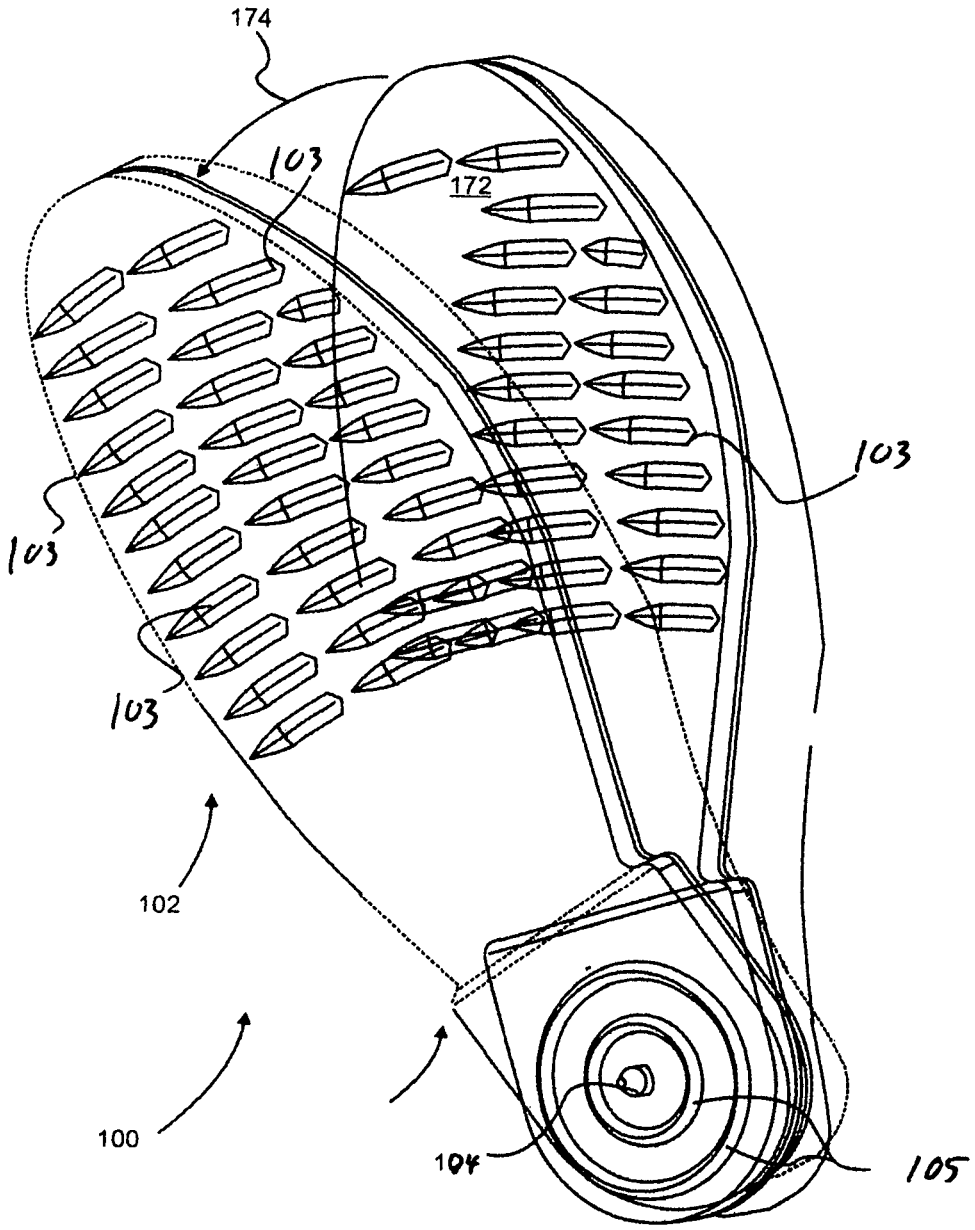
FIG. 2B is the bottom perspective view of the embodiment from FIG. 1A showing the outward one-way rotation of the shoe about the rotation point pattern in the heel portion of the shoe.

174 in FIG. 2B displays the outward, one-way rotations of the sole about the center cone spike 104.

Figure 3C:
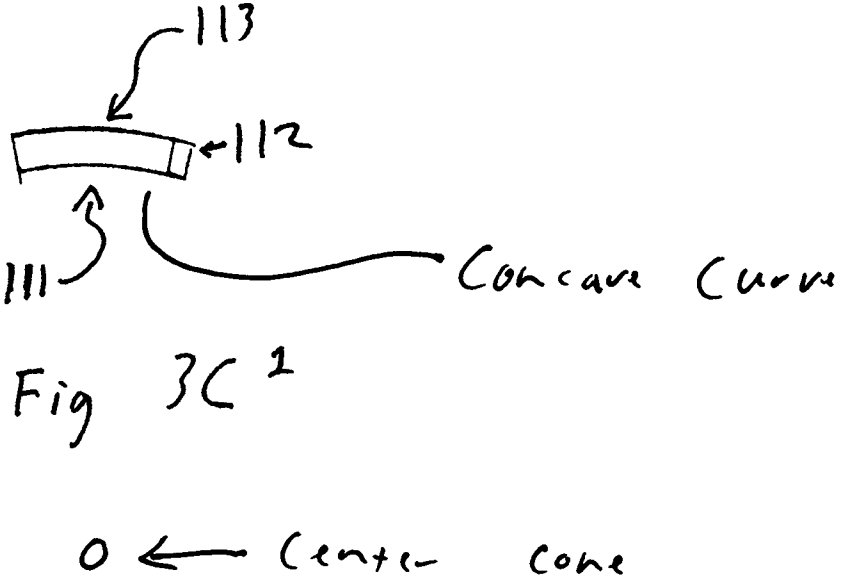
FIG. 3$A_{(1, 2)}$ is a perspective side view of an exemplary embodiment of one of the one-way guide blades.
FIG. 3D is a cross-sectional view of the one-way guide blade from FIG. 3C

107 in FIG. 3$A_{(1\ and\ 2)}$, FIG. 4,8,9,10 displays the outward or slide side of the 103 outward, one-way rotation blade, as displayed in the image the blades gradually protrudes from the sole on the outward side enabling the sole to slide or rotate in that direction.

108 in FIG. 3$A_{(1\ AND\ 2)}$, FIG. 4, 8,9,10 displays the middle of the outward, one-way rotation blade, as the image portray the middle of the blade has a slight curve to a level or parallel to the sole portion up to the stop or barb side of the blade.

109 in FIG. 3$A_{(1\ AND\ 2)}$, FIG. 4, FIG. 8, 9, 10 is an example of how the stop end of the blade sharply cuts back into the sole at an acute angle from the sole to the member and from the top of the member to the catch side of the member forming a sharp barb to grip the ground.

Figure 3D:
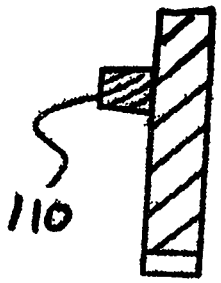
Figure 4:
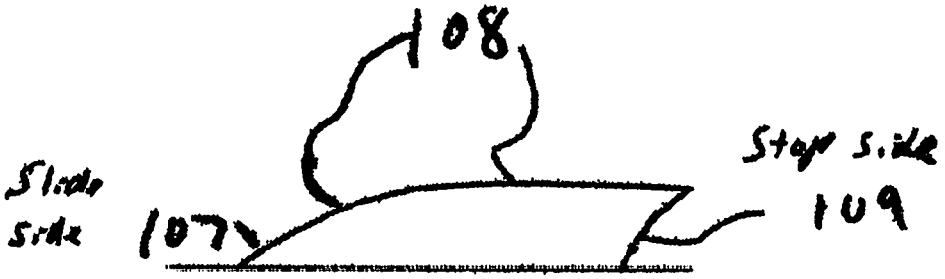
FIG. 4 is a side view of an exemplary embodiment of one of the one-way guide blades with a gradually protruding slide side and a sharply inverse angled stop side.

110 in FIG. 3$B_{(1\ and\ 2)}$ and FIG. 3D is an example of the substantially squared shape of the outward, one-way rotation blades and the circle blades as seen from a cross-section perspective, the top is flat or squared to the sides.

111 in FIG. 3$C_{(1\ and\ 2)}$ displays the radius curve of the blade about the center cone spike so the any on location on the blade will measure the exact same distance from the center cone spike as any other location on the same blade.

112 in FIG. 3$C_{(1\ and\ 2)}$ illustrates the portion of the blade that overhangs or expands past the point of the same side of the blade by which the blade attaches to the sole.

113 in FIG. 3$C_{(1\ and\ 2)}$ is an example of the substantially square yet slightly curved shape of the outward, one-way rotation blade illustrating the concave curve to the center cone.

Figure 5B:
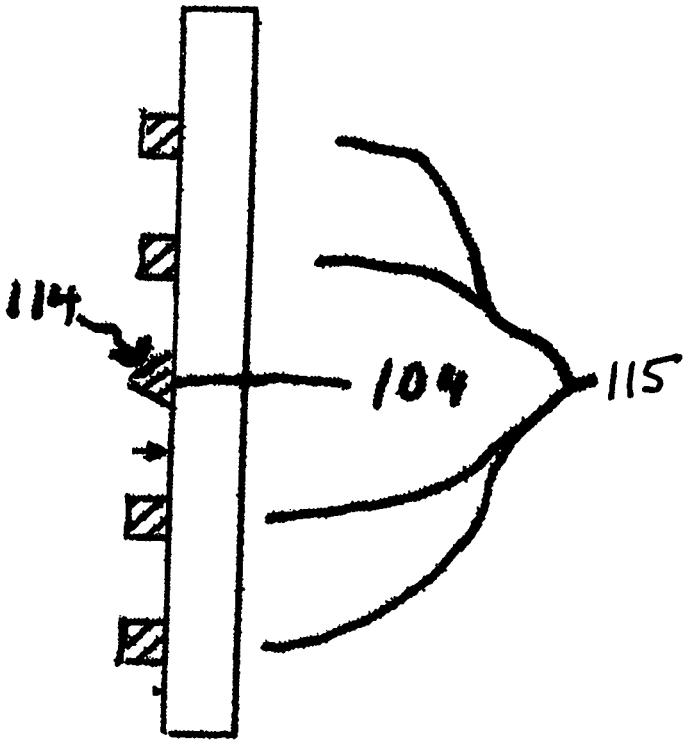
FIG. 5B is a cross-sectional view of the rotation point pattern form FIG. 5A take from the cross-sectional line shown in FIG. 5A.
Figure 6:
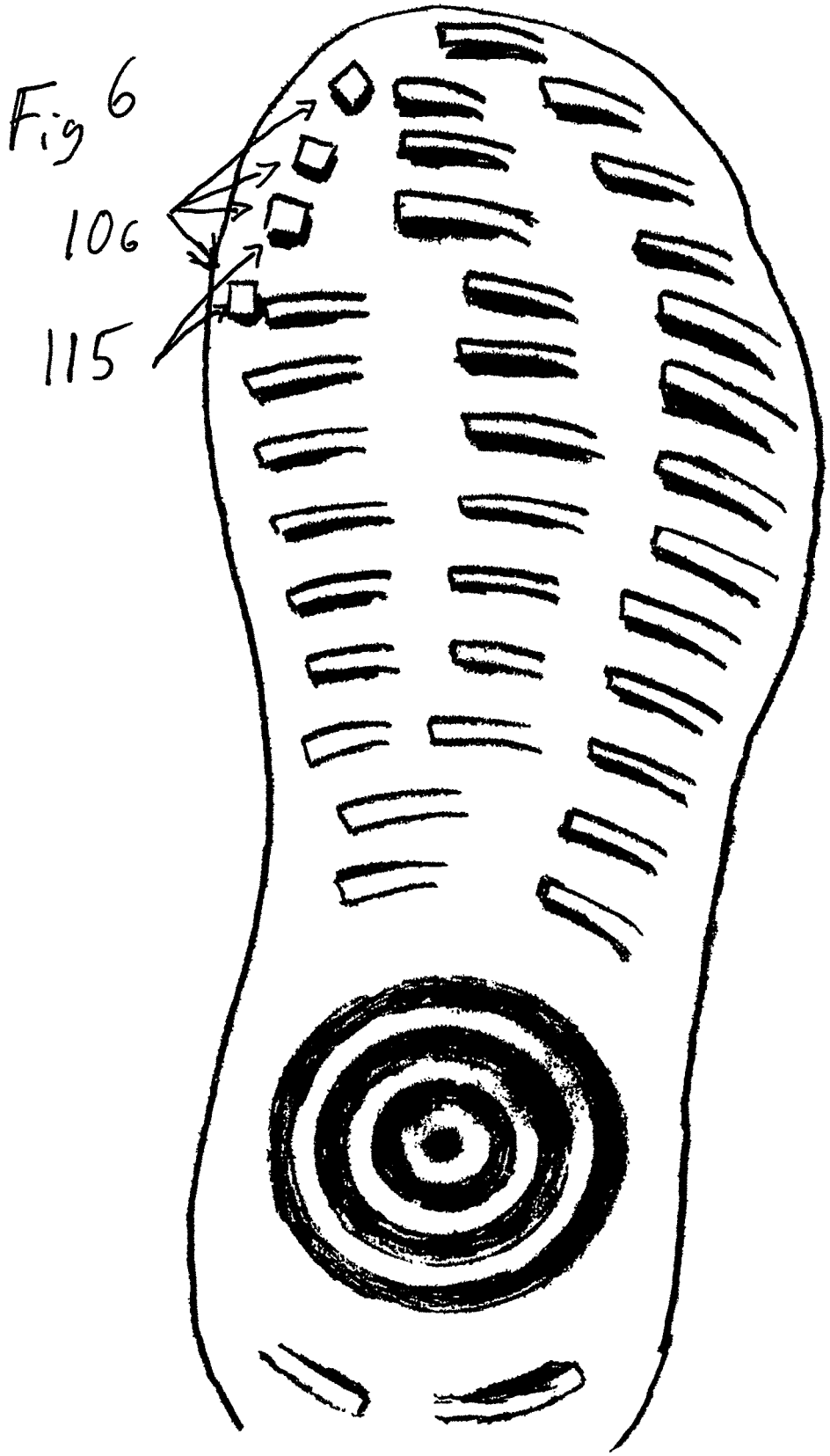
FIG. 6 is a bottom perspective view of the counter rotation spike on the inner toe portion of the sole.

114 in FIG. 5B illustrates the conical shape of the center cone spike 104.

115 in FIG. 6,8,9,10 displays the substantially square shape of the counter rotate spike.

Figure 7:
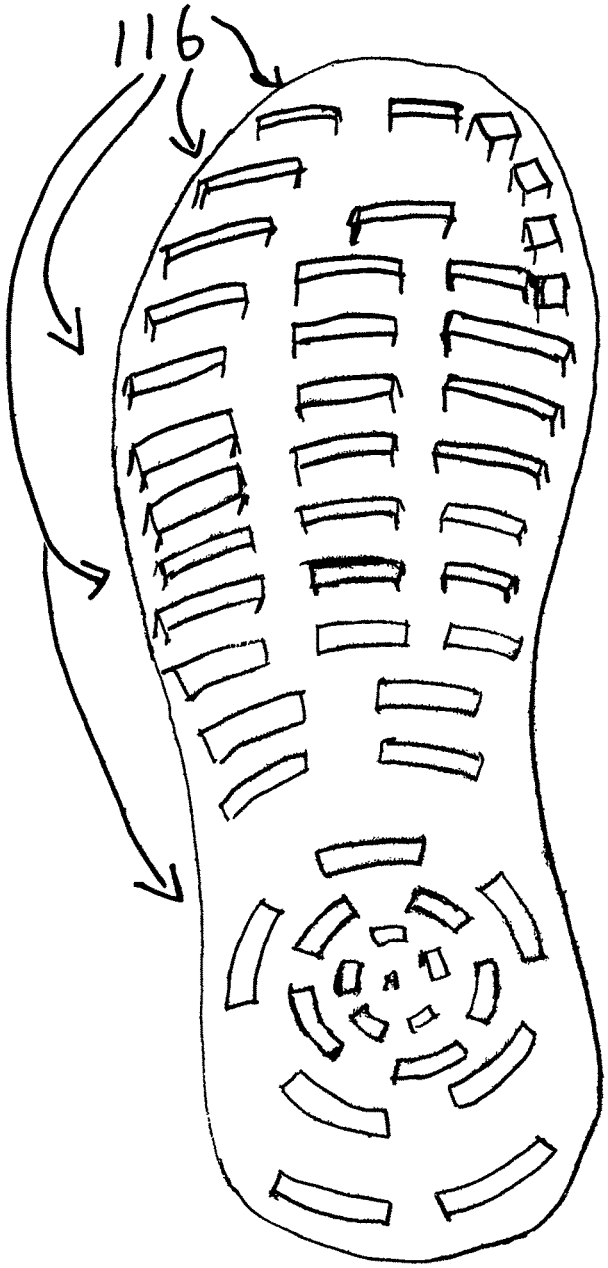
FIG. 7 is the bottom perspective view of the non-rotation shoe for the rear or foot furthest from the target area at setup.
Figure 8:
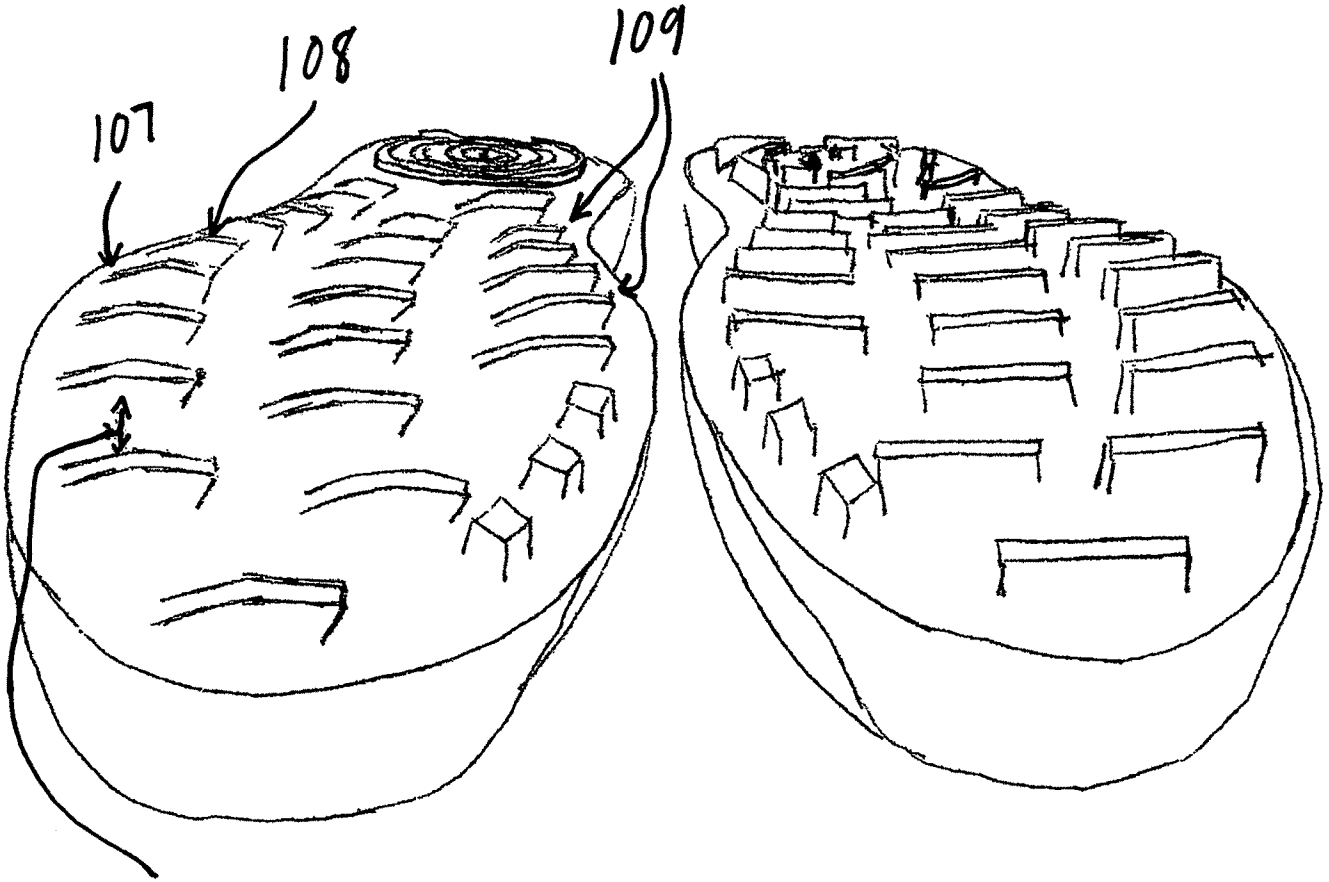
FIG. 8 is the bottom perspective of the actual outward rotating golf shoe sole and it partner the bottom perspective of the non-rotating golf shoe looking from a front angle.
Figure 9:
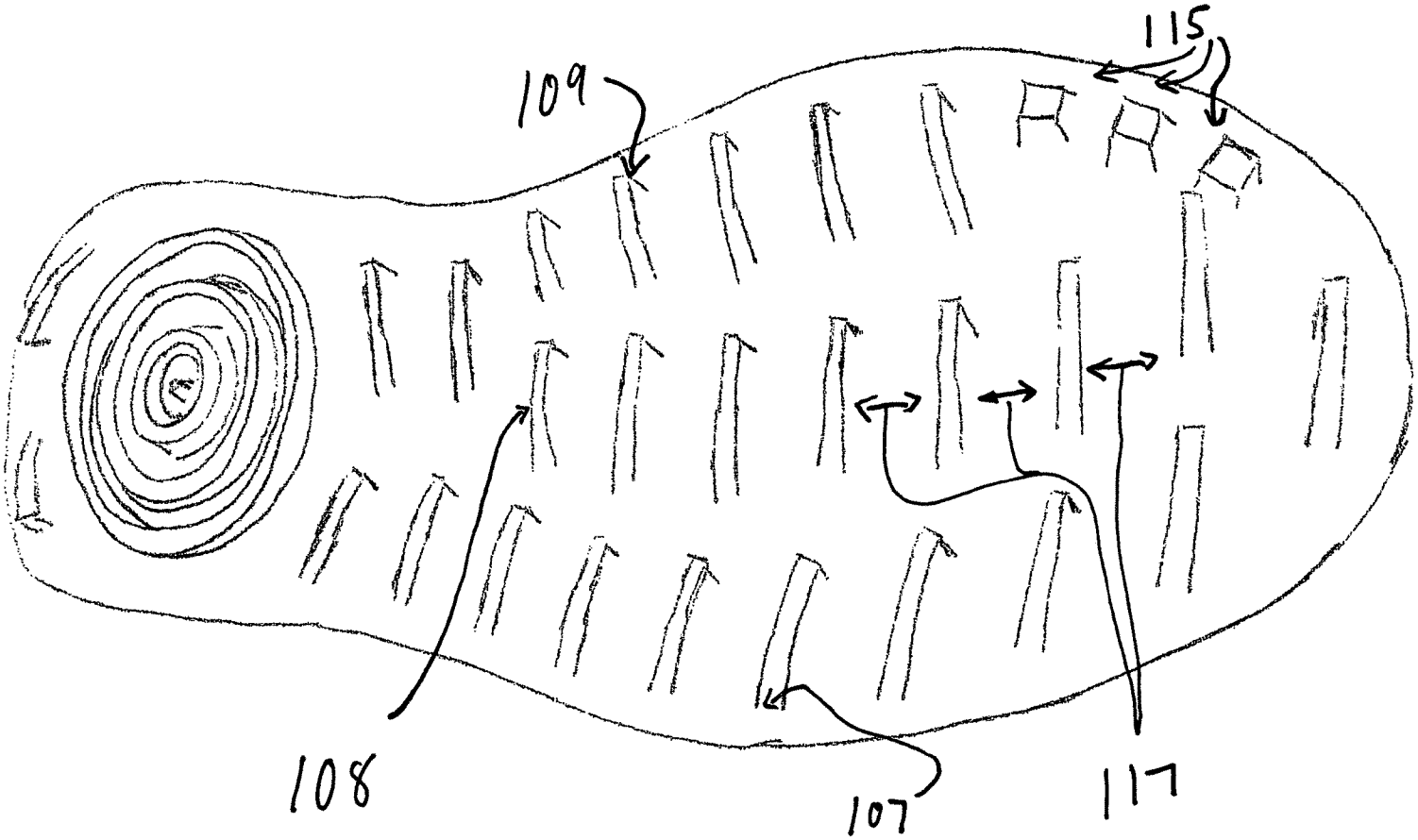
FIG. 9 is the bottom perspective of the actual shoe sole from a slightly side front angle.
Figure 10:
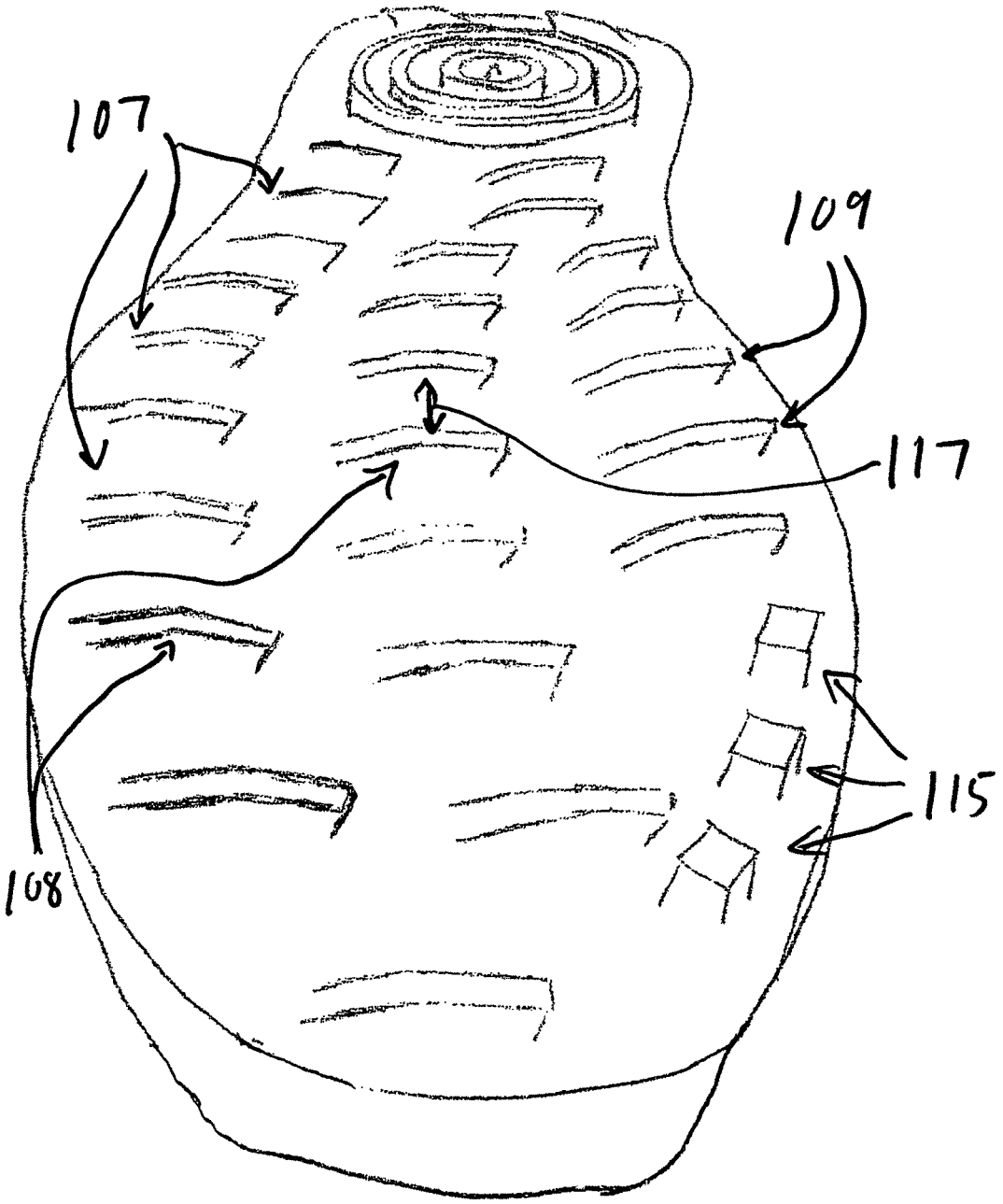
FIG. 10 is a bottom perspective of the actual shoe sole from the front angle without it partner the non-rotating golf shoe.

116 in FIG. 7 displays the tread that does not allow rotation in any direction.

117 in FIG. 2-10 displays the substantially parallel arc all of the outward, one-way rotation blade rows are positioned.

MODELS OR SPECIMENS

A finished product can be supplied at the request of the USPTO. A finished product can also be view on the website: orgsgolf.com

The invention claimed is:

1. A shoe sole with a pattern configured for one-way rotation in one direction and exceptional traction for the other direction comprising:

the pattern having:

a one directional rotation pattern including one cone shaped spike at a center point or axis of said one directional rotation; one or more circular members or blades concavely curved around the center cone shaped spike forming a circle such that any point on a particular circle member or blade will be approximately equal distance from the center cone spike to any other point on the same said circle member or blade: and a one-way directional rotation pattern of one-way guide blades having two different functioning and designed ends, said one-way rotation pattern of one-way guide blades including more than one row of substantially parallel and concavely axial curved one-way guide blades around the center point so that any point on the one-way guide blade will be approximately equal distance from the center point to any other point on the same one-way guide blade, each of the rows exclusively including one-way guide blades, each one-way blade with a slide end on a same end, facing an outside edge of the shoe sole and a catch or stop end on the other end of the one-way guide blade facing an inside edge of the shoe sole, each of the one-way guide blades being an elongated member extending partially from the inside edge of the shoe sole towards the outside edge of the shoe sole in an axial direction concavely curved about the center point of the cone shaped spike, each of the one-way guide blades having:

a top portion that is flat or squared, the slide end on one end of the one-way guide blade including a gradually protruding or slanted portion gently extending from the shoe sole to the top portion of the one-way guide blade in a gradual or sloped direction forming an inclined plane from the slide end from the shoe sole to a part of the one-way guide blade furthest from the shoe sole or top portion of the one-way guide blade when the shoe is upside down, whereby the one-way guide blade is configured to allow the one-way rotation toward the slide end of the one-way guide blade that gradually protrudes from the shoe sole at an extremely obtuse, almost 180 degree angle, all of the gradually protruding or slanted portion of said one-way guide blades are positioned facing the outside edge of the sole: and the stop or catch end of the one-way guide blades including a barb or sharp terminal end, said barb or sharp terminal end extending from the shoe sole to the top portion in an inverse angle or sharp direction resembling a shape of the number seven when the shoe is upside down, the barb or sharp terminal end is angled downwards toward the shoe sole where an exterior of the barb or sharp terminal end forms an acute angle to the shoe sole, the acute angle transitioning from the part of the one-way guide blade furthest from the shoe sole or top portion of the one-way guide blade when the shoe is upside down, whereby the one-way guide blade is configured to restrict movement opposite one-way rotation toward the stop or catch end of the one-way guide blade that sharply or inversely protrudes from the shoe sole forming the barb or sharp terminal end extending from the shoe sole at the acute angle; whereby the shoe sole is configured to rotate in one direction about said center point of the cone shaped spike, and catch or stop in an opposite direction wherein all of the barb or sharp terminal end of the one-way guide blades will be positioned facing the same direction toward the inside edge of the sole.

2. The shoe sole of claim 1, wherein said center point of the cone shaped spike including a substantially conical shaped top with substantially all other members on the sole positioned and concavely curved in a radius of curvature so that all members are in a curved parallel pattern orbiting the center point of the cone shaped spike, whereas, where the area of the shoe sole allows, the members will be a complete circle around the center point of the cone shaped spike.

3. The shoe sole of claim 1, wherein said one directional rotation pattern including at least one ring blade around said center point of the cone shaped spike that completely encircles the center cone; wherein said ring blade has a flat or squared top or side furthest from the sole.

4. The shoe sole of claim 1, wherein substantially all of said one-way guide blades having a radius of concave curvature approximately whereas any point on the same blade will be equal to a distance from said center point of the cone shaped spike.

5. The shoe sole of claim 1, wherein said one directional rotation pattern further comprising: all members and rows orbiting the center point for a one-way rotation pattern.

6. The shoe sole of claim 4, wherein: said one directional rotation pattern including ring blades spaced around said center point of the cone shaped spike; each of said ring blades having a square-shaped top; and said center point of the cone shaped spike having a center height being approximately equal to a ring height of said ring blades.

7. The shoe sole of claim 1, wherein: each of said one-way guide blades including a substantially square-shaped top portion.

8. The shoe sole of claim 1, wherein said one-way rotation pattern including a counter rotate spike, wherein said counter rotate spike being positioned off of an inner toe portion, having a substantially square or trapezoidal cross-section, whereby said counter rotate spike being configured to: give traction extension during the counter rotate portion of the swing; and/or provide traction for walking.

9. The shoe sole claim 1, wherein said pattern having:

only one directional rotation pattern and only one center point; wherein, the shoe sole being for a front shoe or shoe closest to the target where the golfer is attempting to hit the ball of a golfer, whereby the front shoe may rotate in one direction towards the intended target, to the outside, about the center point of the cone shaped spike.

10. A golf shoe with a sole having a pattern configured for one-way rotation comprising:

the pattern having:

a rotation point pattern including a center point tread consisting of a cone shaped spike; and a one-way rotation pattern, said one-way rotation pattern including more than one row, each of the rows including at least one one-way guide blade, each of the one-way guide blades being an elongated member extending at least partially from an outside edge of the sole to the other edge or an inside edge of the sole in a concavely curved, axial direction about the center point tread, each of the at least one one-way guide blades having:

a flat or squared top portion, the top portion being a side of the one-way guide blade furthest from the sole: a slide end or inclined plane side of the one-way guide blade gradually protruding or slightly angled portion extending from the sole to the top portion in a rounded or gradually slanted direction at an obtuse angle almost 180 degrees, whereby the one-way guide blade is configured to allow the one-way rotation toward the slide end of the one-way guide blade; the slide or inclined plane ends of the one-way guide blades being positioned on a side of the one-way guide blade closest to the outside edge of the sole: and a stop end or catch end on the other end of the one-way guide blade including a barb or inversely ascending terminal end, said barb or inversely ascending terminal end extending from the sole to the top portion in an inverse direction or sharp angle, where the barb or inversely ascending terminal end has a sharp barb on a top (side away from the sole) to dig into the ground and afford traction, forming an acute angle to the sole, the stop or catch end form an acute angle at the transition from the top or side furthest from the sole to a catch side of member, whereby the one-way guide blade is configured to restrict movement opposite the one-way rotation toward the stop or catch end of the one-way guide blade that sharply or drastically protrudes from the sole via the sharp barb extending from the sole; whereby the golf shoe is configured to rotate in one outward direction about said center point tread of the rotation point pattern and configured to catch in the other inward direction of the center point tread of the rotation point pattern.

11. The golf shoe of claim 10, wherein said pattern further having more than one row having more than one one-way rotation blades.

12. The golf shoe of claim 10, wherein all of said one way guide blades having; a radius of curvature approximately equal to a distance from a center of said rotation point pattern such that any point on a particular one way guide blade will measure the same distance from the center point tread as any other point on the same one way guide blade.

13. The golf shoe of claim 10, wherein where the slide ends of each of the one-way guide blades are facing the outside edge of the sole and the stop ends of each of the one-way guide blade are facing the inside edge of the sole.

14. The golf shoe of claim 10, wherein the slide ends of each of the one-way guide blade are facing a same direction and the stop ends of each of the one-way guide blade are facing a same direction.

15. The shoe sole of claim 1, wherein the cone shaped spike and the circular members or blades are located on a heel portion of the shoe sole; and the one way guide blades are located on a front portion of the shoe sole.

16. The golf shoe of claim 10, wherein the cone shaped spike is located on a heel portion of the shoe sole; and the one way guide blades are located on a front portion of the shoe sole.

* * * * *